United States Patent [19]

Cooper

[11] Patent Number: 4,819,977

[45] Date of Patent: Apr. 11, 1989

[54] OBJECTIONABLE WASTE MATERIAL RETRIEVAL AND BAGGING DEVICE

[75] Inventor: Robert E. Cooper, Las Vegas, Nev.

[73] Assignee: Alfred Sites, Las Vegas, Nev.

[21] Appl. No.: 88,660

[22] Filed: Aug. 24, 1987

[51] Int. Cl.[4] ..... A47F 13/06

[52] U.S. Cl. ..... 294/1.4

[58] Field of Search ..... 294/1.3, 1.4, 19.1, 294/1.1

[56] References Cited

U.S. PATENT DOCUMENTS

| | | | |
|---|---|---|---|
| 3,777,708 | 12/1973 | Vogt | 294/19 |
| 3,868,135 | 2/1975 | Magliaro | 294/1 |
| 3,942,831 | 3/1976 | Sosnove | 294/1.4 |
| 3,977,422 | 8/1976 | Cabaluna | 294/19 |
| 4,179,145 | 12/1979 | Shinsako | 294/19 |
| 4,225,169 | 9/1980 | DeToma | 294/1 |
| 4,253,691 | 3/1981 | Liu | 294/1 |

*Primary Examiner*—James B. Marbert

[57] ABSTRACT

Device to be used, as the preferred embodiment, for dog feces retrieval and bagging. The simplicity of construction and operation allows use by persons of all ages without undue effort or bending. The retrieval and bagging and tying and containing of waste material in one operation has not heretofor been realised. The device consists of a hollow tube with eight flexible fingers on one end, a removable sleeve over the tube, and a lanyard and cap at the other end, and a plastic bag with rubber band. When the plastic bag is placed over the exposed fingers, the bag end folded back and fixed with a rubber band over the sleeve, the sleeve is then moved forward over the exposed and bagged fingers. Retracting the sleeve thus exposing the bagged fingers, the device is placed over the waste material to be retrieved. By moving the sleeve forward the fingers are caused to draw in the waste material, into the bag, and into the tube, the rubber band slipping over the fingers and tying the bag. The bag containing the waste material is held within the device out of view and is ejected by retracting the sleeve.

1 Claim, 2 Drawing Sheets

OBJECTIONABLE WASTE MATERIAL RETRIEVAL AND BAGGING DEVICE

BACKGROUND OF THE INVENTION

1. Field of the Invention

This invention relates to retrieval devices of the type which is self contained, portable, operated by hand to retrieve waste material such as dog feces by gathering it into a bag inserted into the device and secured by a rubber band thereby enabling the user to retrieve feces and similar waste material without the user or the device or the outside of the bag touching the feces or material, and with having the feces or similar waste material bagged and tied with a rubber band, and contained within the device ready for ejection and sanitary disposal.

2. Discussion of the Prior Art

There has long been a need for a device that will allow a person to retrieve objectionable waste material such as dog feces, and to be able to place it in a container without the user, the device, or the outside of the container coming in contact with the material; and without the user having to handle the waste-filled container; and to do it in one simple operation.

There have been many devices proposed to assist in waste material retrieval. All of such devices require considerable bending, scooping, lifting of the material, transporting the material for disposal. None of the prior art provides for the element of bagging, tying, and ejection of said material as the primary integral function of the device so the waste material can be retrieved, bagged and tied easily in the same operation; the bagged and tied material can be concealed within the device and can be ejected automatically when desired.

SUMMARY OF THE INVENTION

Objects and Advantages

Dog feces and similar objectionable waste material retrieval and bagging device is provided which allows the user to retrieve any such material and cause it to be bagged in a sanitary container and automatically tied at the top with a rubber band; and drawn into the device and then ejected when so desired.

The principal object of the invention is to allow the user to retrieve dog feces or similar objectionable waste material and have it bagged and tied, and contained within the device out of view, and ejected for sanitary disposal, as an integral function to the operation of the device.

A further object of the invention is to allow the user to retrieve objectionable waste material without undue bending, lifting, pushing or pulling, and to have said material safely contained within the device without it having touched the user, the device, or the outside of the bag into which it is gathered.

A further object of the invention is to provide the user with the opportunity to carry the device with the bagged and tied waste material concealed inside the device convenient for sanitary disposal.

Further objects and advantages of my invention will become apparent from a consideration of the drawings and ensuing description of it.

DESCRIPTION OF THE DRAWINGS

The nature and characteristics of the invention will be more readily understood from the following description taken in connection with the accompanying drawings and forming a part hereto, in which.

Figure 1:
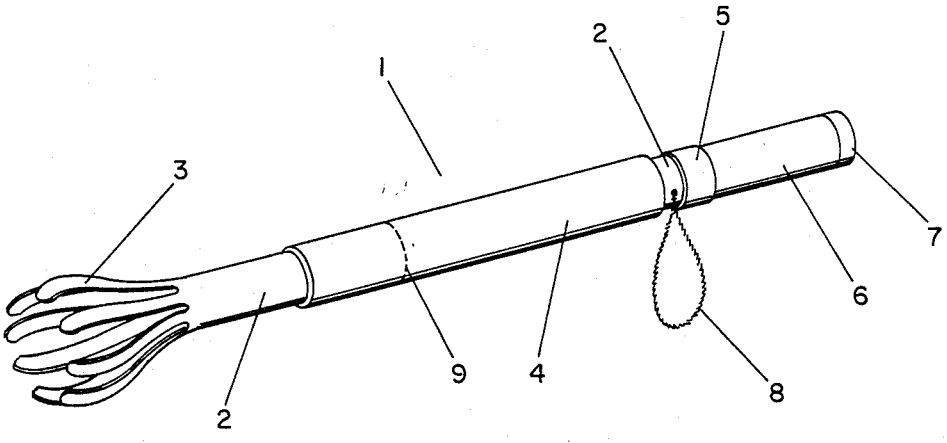
FIG.1 is a view in perspective illustrating the device of the invention.

It should be understood that the drawings and descriptions herein are illustrative merely, and that various modifications and changes can be made in the structure disclosed without departing from the spirit of the invention.

Like numerals refer to like parts throughout the several views.

DRAWING REFERENCE NUMERALS

1. Embodiment
2. Body
3. Fingers
4. Sleeve
5. Collar
6. Handle
7. Cap
8. Lanyard
9. Bag Limit Line
10. Lanyard Hole
11. Plastic Bag
12. Rubber band

DESCRIPTION OF THE PREFERRED EMBODIMENT

Referring now more particularly to the drawings and FIGS. 1 to 4 inclusive, in FIG. 1 the retrieval device is shown as having a hollow tubular body 2 which is provided with eight flexible fingers 3 at the forward end, with a sleeve 4 fitting over the tubular body 2, and a lanyard 8 inserted in the opposite end of the body 2. The hollow handle 6 has a collar 5 which fits over the body 2 and with a cap 7 at the end.

Figure 2:
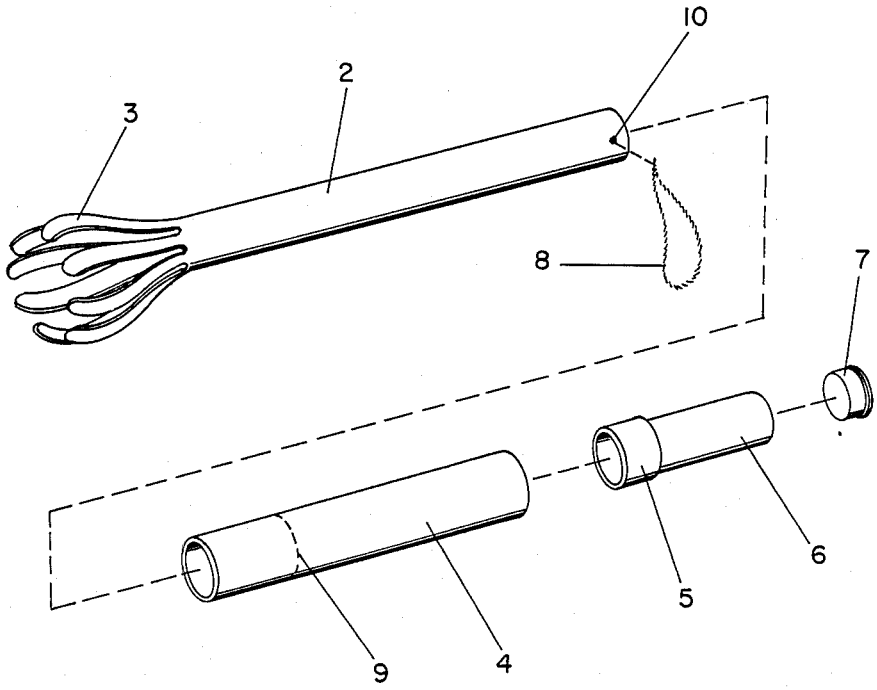
FIG.2 is a side view of the several parts of the invention.

FIG. 2 shows the several parts in their relation to the embodiment 1.

Figure 3:
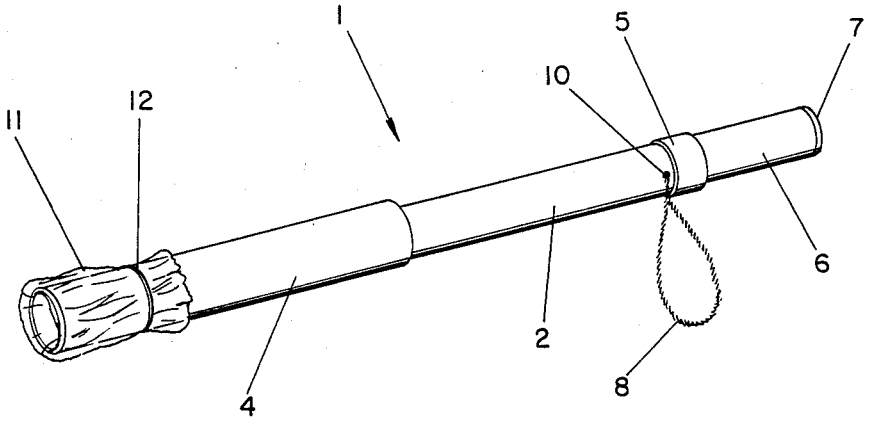
FIG.3 is a view in perspective showing the bag attachment in relation to the movable sleeve.

FIG. 3 shows the sleeve 4 moved to the forward position over the eight flexible fingers 3 on the body 2 with a bag 11 inserted inside the fingers 3 and folded over the sleeve 4 to the bag limit line 9 and secured with a rubber band 12.

Figure 4:
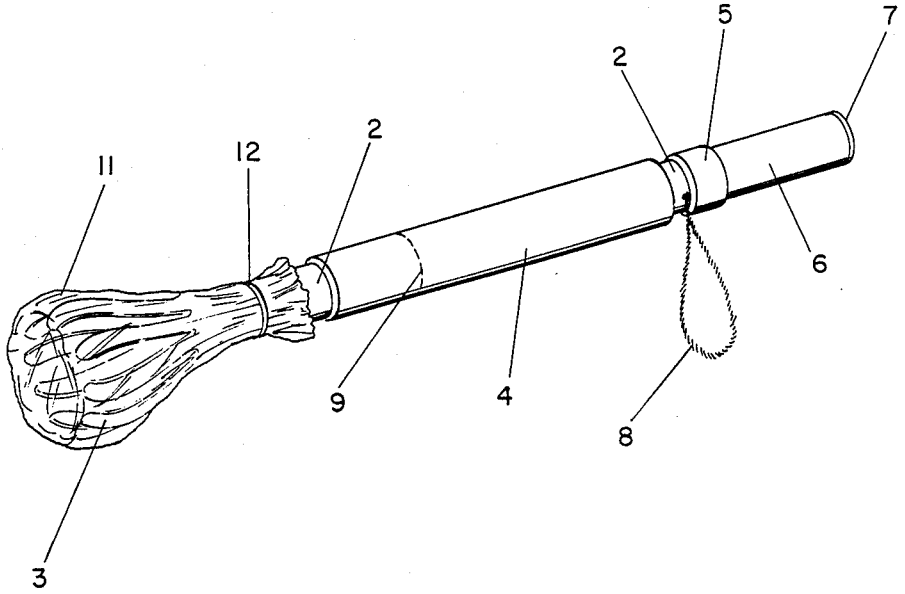
FIG.4 is a view in perspective showing the bag involvement with the eight retrieval fingers of the device.

FIG. 4 shows the sleeve 4 pulled back to the collar 5 allowing the eight fingers 3 to emerge encased in the bag 11 affixed with the rubber band 12 which now holds the bag 11 to the body 2.

The mode of operation will now be pointed out.

The device is held by the handle 6 and the sleeve 4 is drawn back exposing the fingers 3. A pliant bag 11 is placed within the fingers 3. The sleeve 4 is drawn up over the fingers 3 and the excess bag 11 is folded back over the sleeve 4 to the line 9 as shown in FIG. 3. A rubber band 12 is then placed over the bag 11 approximately one inch from the bag 11 end. The sleeve 4 is then drawn back exposing the fingers 3 encased in the pliant bag 11, the rubber bag 12 has been pulled away from the sleeve 4 and now secures the bag 11 on the body 2, as shown in FIG. 4.

The device 1 with the attached bag 11 is then placed over the waste material to be retrieved. By holding the body 2 firm and by moving the sleeve 4 down over the fingers 3, the fingers 3 gather in the waste material to be retrieved. The bag 11 now containing the waste material is covered by the sleeve 4, the rubber band being pulled over the fingers 3, tying the bag 11. By holding the handle 6 and by rapidly moving the sleeve 4 backward, the tied bag 11, now holding the waste material, is ejected by the flexing of the fingers 3, the rubber band 12 having secured the end of the bag 11.

The device 1 is approximately 30 inches in length thus of a size requiring limited bending by the user. The device 1 can be carried by the lanyard 8 when not in use, or with waste material inside. The end cap 7 can be removed so the hollow handle 6 can be used as a bag 11 storage. The user can carry the waste material within the bag 11 out of sight, covered by the sleeve 4 until disposal is desired. The device 1 is designed to accomodate waste material of the average size dog and can be made larger to accomodate the waste material of larger dogs or other animal or other material.

It will thus be seen that the structure has been provided with which the objects of the invention are obtained.

I claim:

1. Device to be used for retrieving and bagging dog feces and similar and other objectionable waste material comprising:

(a) a tubular body with eight flexible finger endings and removable tubular sleeve (b) a plastic or similar pliant material bag inserted into the eight flexible fingers, the fingers and bag brawn into the sleeve with the excess bag folded over the sleeve and held by a rubber band placed over the bag and sleeve (c) moving the body forward from the sleeve to expose the bag around the eight flexible fingers secured by a rubber band (d) operation means by placing the device over the material to be retrieved, and moving the sleeve over the fingers thereby gathering and bagging the material and tying the bag and containing the bag within the device (e) ejecting the tied and bagged material by pulling the sleeve back.

* * * * *